US005749810A

United States Patent [19]

Fenstermaker

[11] Patent Number: 5,749,810

[45] Date of Patent: May 12, 1998

[54] UPPER BODY EXERCISER

[76] Inventor: Charles L. Fenstermaker, 2765 Valley View Ave., Salt Lake City, Utah 84117-5467

[21] Appl. No.: 547,282

[22] Filed: Oct. 24, 1995

[51] Int. Cl.[6] ..... A63B 22/12

[52] U.S. Cl. ..... 482/57; 482/62

[58] Field of Search ..... 482/57, 62, 91, 482/92, 128

[56] References Cited

U.S. PATENT DOCUMENTS

| | | | |
|---|---|---|---|
| 4,517,966 | 5/1985 | von Othegraven | 482/128 |
| 4,834,366 | 5/1989 | Hotchkiss | 482/128 |
| 5,125,648 | 6/1992 | Olschansky et al. | 482/62 |
| 5,199,933 | 4/1993 | Illuzzi | 482/62 |
| 5,403,269 | 4/1995 | Kennedy | 482/128 |

FOREIGN PATENT DOCUMENTS

| | | | |
|---|---|---|---|
| 1012574 | 6/1972 | Canada | 482/128 |

*Primary Examiner*—Stephen R. Crow
*Attorney, Agent, or Firm*—Terry M. Crellin

[57] ABSTRACT

A portable exercise device is hand held on the legs just above the knees while pedaling a stationary bicycle or similar pedal type exerciser. The device includes an elongate, straight member having a handle at one end and a leg engaging member at the other end. A user grasps the handle of the device in his or her hand and positions the leg engaging member on his or her leg at a position above the knee. The device and the hand and arm of the user are raised and lowered synchronously with one's knee as one pedals the stationary bicycle.

1 Claim, 1 Drawing Sheet

UPPER BODY EXERCISER

BACKGROUND OF THE INVENTION

1. Field of the Invention

The present invention relates to a simple, inexpensive device to be used by a person when riding a stationary bicycle whereby the device of the present invention will provide upper body exercise while the person rides the stationary bicycle.

2. State of the Art

A search through prior U.S. Patents did not reveal any device similar to the present device that is used to exercise the upper body of a person while the person is riding a stationary bicycle.

BRIEF DESCRIPTION OF THE INVENTION

It is an object of the invention to provide an inexpensive device that is simple and easy to use and which is effective to exercise the upper body when a person is riding a stationary bicycle. The device comprises an elongate member having one end that is adapted to be removably secured to the leg of the person riding the stationary bicycle. The elongate member is secured to the person's leg at a position just above the knee joint of the person's leg.

The other end of the elongate member is provided with a handle which can be grasped by a hand of the person riding the bicycle. When the device is attached to the leg of a person riding a stationary bicycle, the device moves the person's hands and arms up and down as the person rides the stationary bicycle. The up and down movement of one's hands and arms provides useful exercise to the upper body of the person riding the stationary bicycle.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which:

FIG. 1 is a pictorial representation of an exercise device in accordance with the present invention; and FIG. 2 is a side view of a person using a device of FIG. 1 on each leg as the person rides a stationary bicycle.

DETAILED DESCRIPTION OF THE ILLUSTRATED EMBODIMENTS

Figure 1:
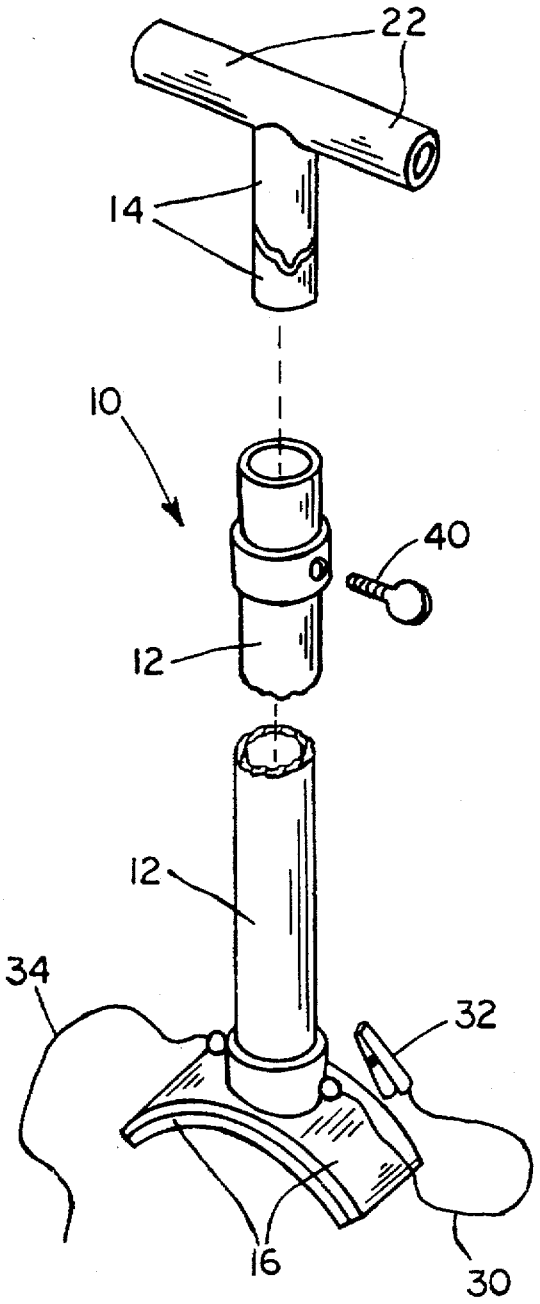

Referring to the drawings, the device of the present invention comprises an elongate member 10. In its most simple form, the elongate member 10 could be a straight, single rod or other tubular, pipe-like member. In the preferred embodiment illustrated in the drawings, the elongate member 10 comprises an elongate, hollow, tubular, lower member 12 and a tubular, upper member 14 that is received telescopically within the upper end of the lower member 12.

Figure 2:
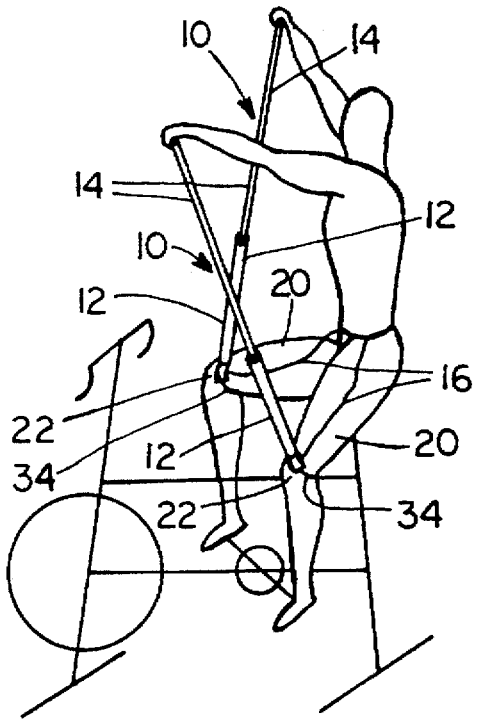

A leg engaging member 16 is attached to the distal, or lower end of the lower member 12. The leg engaging member 16 is adapted to rest comfortably on the leg 20 of the user at a point adjacent to or closely above the knee 22 of the user as shown in FIG. 2. In a preferred embodiment of the invention, the leg engaging member 16 is shaped so as to at least partially conform to the upper surface of the user's leg. It is advantageous if the leg engaging member 16 cradles the upper surface of the user's leg in a comfortable manner. To this end, the leg engaging member 16 is advantageously formed to have a smooth, concave shape that fits around the upper surface of the user's leg. To provide comfort, the surface of the leg engaging member 16 that contacts the user's leg can be padded.

A handle 22 is provided at the end of the upper member 14. As illustrated, the handle 22 can be a simple, short tubular piece that is attached near the center portion of the handle 22 to the distal end of the upper member 14. It should be recognized that the handle could be of any number of shapes. All that is necessary is that the handle 22 be capable of being readily grasped in the hand of a user of the device.

In using the device of the present invention, one mounts a stationary bicycle and grabs the handle 22 of at least one of the devices in his or her hands. It is advantageous to use two of the devices as shown in FIG. 2 of the drawings. The devices are held firmly against the user's legs at a position adjacent to the knees. As the user pedals the bicycle, the devices of the present invention will raise and lower the hands of the user and thus exercise the upper body of the user as well as the legs of the user.

It is advantageous to provide a strap 30 that is attached to the device at a position near the lower end of the lower member 12. A clip 32 is attached to the free end of the strap 30. The clip 32 can be attached to the belt or clothing of the user at the waist of the user as shown in FIG. 2. When the clip 32 is attached to waist of the user, the device of the invention is maintained in place on the legs of the user with minimum effort from the user. The strap 30 and clip 32 are not essential, but they will help a user learn to use the device. Another strap 34 can be provided on the lower end of the lower member 12. This second strap 34 can encircle the leg of the user to securely hold the device in place on the user's leg. Again, the strap 34 is not necessary, but it will accommodate the initial use of the device or the use of the device by users whose arms can not initially capable of holding the device firmly against their legs.

It is advantageous to provide means for adjusting the length of the elongate member 10. This can easily be accommodated by providing a thumb screw 40 near the top of the lower member 12. The thumbscrew 40 can be tightened down on the portion of the upper member 14 that is telescopically received in the lower member 12 so as to allow the upper member 14 to be secured with an adjustable amount of the upper member 14 extending from the lower member 12. Even greater adjustment can be achieved by providing a pair of similar upper members 14 in which one is simply longer than the other. Advantageously, two such members 14 can be provided. One of the members will have a length of about 15 inches, while the other has a length of about 30 inches. With the two members, the effective length of the elongate member 10 can be adjusted over a wide range.

The device of this invention will aid people of all ages to get a greater variety of upper body exercise. People recovering from strokes, heart surgery, surgery on a wrist, elbow or shoulder will be helped considerably because the strenuous exercise is nearly eliminated inasmuch as the legs do the work. A person will be able to start very slow and build up the frequency of movement as required or desired. They will also be able to get extension as needed. They will be able to sit up straight allowing them to breath deeper and permit their respiratory and cardiovascular systems to function more correctly while using the device. A person with back problems will be able to exercise the rest of his or her body with minimal movement of the back. By moving the hands to different positions and using various length adjustments, the exercising possibilities are numerous.

Although a preferred embodiment of the exercise device of the present invention has been illustrated and described, it is to be understood that the present disclosure is made by way of example and that various other embodiments are possible without departing from the subject matter coming within the scope of the following claims, which subject matter is regarded as the invention.

I claim:

1. A pair of portable hand-held elongate exercise supports for use while bicycle pedaling, each support comprising a lower tubular rod; a leg engaging member integrally connected to said lower rod and having a bottom padded thigh engaging portion, said portion sized and contoured to engage the thigh of a user; an upper T-shaped tubular rod adapted to be telescopically and adjustably received within said lower tubular rod, the T-portion of said rod functioning as a hand grip, a lower collar secured to said lower rod, and at least one cord attached to said collar and having a clip for attachment to the user for releasably securing a respective support to the user; whereby said leg engaging member is maintained in engagement with a leg of the person and the arms move in unison with the movement of the person's knees while pedaling.

* * * * *